United States Patent [19]

Welch

[11] 4,237,578

[45] Dec. 9, 1980

[54] RELEASABLE RETAINING MEANS AND FIRE DOOR CONTROL SYSTEM

[75] Inventor: Anthony H. E. Welch, Corsham, England

[73] Assignee: Dorgard Limited, Corsham, England

[21] Appl. No.: 936,901

[22] Filed: Aug. 25, 1978

Related U.S. Application Data

[63] Continuation-in-part of Ser. No. 793,433, May 3, 1977, Pat. No. 4,121,319.

[30] Foreign Application Priority Data

May 11, 1976 [GB] United Kingdom ..... 19352/76
Jan. 31, 1978 [GB] United Kingdom ..... 3787/78

[51] Int. Cl.[3] ..... E05F 15/20

[52] U.S. Cl. ..... 16/48.5; 16/66; 16/84

[58] Field of Search ..... 16/48.5, 51, 66, 82, 16/84

[56] References Cited

U.S. PATENT DOCUMENTS

| | | | |
|---|---|---|---|
| 2,190,653 | 2/1940 | Dunn | 16/49 |
| 2,813,294 | 11/1957 | Civitelli | 16/137 |
| 3,219,374 | 11/1965 | Snell | 292/72 |
| 3,394,427 | 7/1968 | Vietz | 16/48.5 |
| 3,553,984 | 1/1971 | Grumbach | 70/99 |
| 3,764,172 | 10/1973 | Standke | 292/15 |
| 3,852,846 | 12/1974 | Slaybaugh | 16/48.5 |
| 3,875,612 | 4/1975 | Poitras | 16/51 X |
| 3,934,306 | 1/1976 | Farris | 16/48.5 |
| 4,050,114 | 9/1977 | Zunkel | 16/48.5 |
| 4,127,966 | 12/1978 | Schmidt | 292/252 |

FOREIGN PATENT DOCUMENTS

| | | | |
|---|---|---|---|
| 2422205 | 12/1974 | Fed. Rep. of Germany | 16/48.5 |
| 1043198 | 9/1960 | United Kingdom . | |
| 1253553 | 11/1971 | United Kingdom . | |
| 1341667 | 12/1973 | United Kingdom . | |

*Primary Examiner*—Ronald Feldbaum
*Attorney, Agent, or Firm*—Young & Thompson

[57] ABSTRACT

Means are provided for retaining fire doors in the open position against the action of spring or other automatic door closers, with remote control release which can be actuated if a fire is detected. In use, one part thereof is mounted on the wall and has holding means for engagement with another part which is mounted on the door. The wall mounted part also includes pneumatically operated actuating means for actuating the holding means when a gas pressure differing from atmospheric pressure is applied thereto so that the door is released when such pressure is removed. The pneumatically operated actuating means of a number of such door holders may be connected to a common gas pressure source together with means for releasing the gas pressure on occurrence of a fire.

15 Claims, 8 Drawing Figures

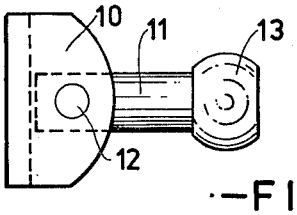
-FIG.1-
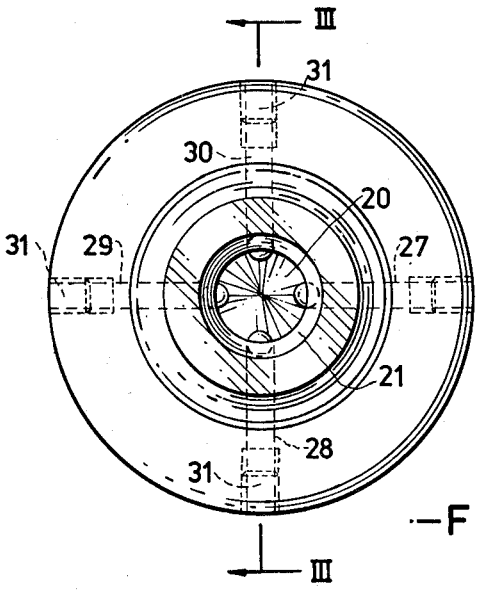
-FIG.2-
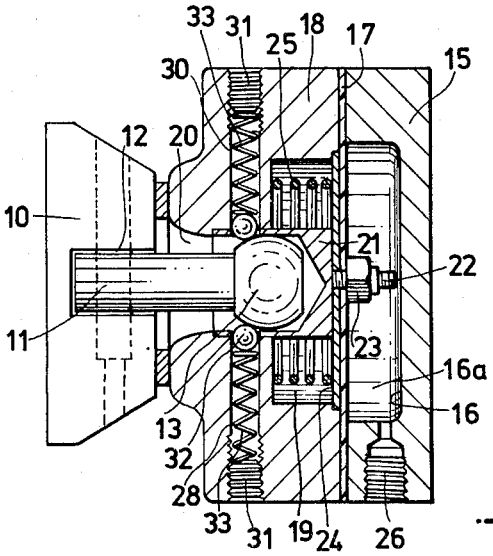
-FIG.3-

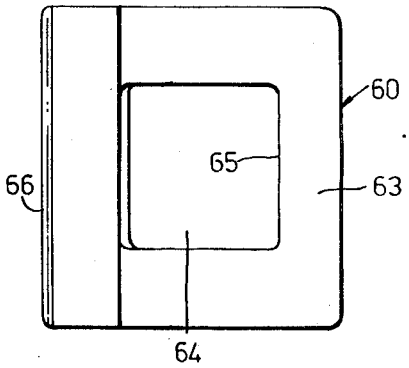
-FIG.5.-
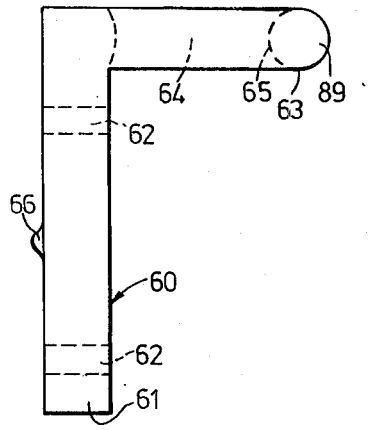
-FIG.6.-
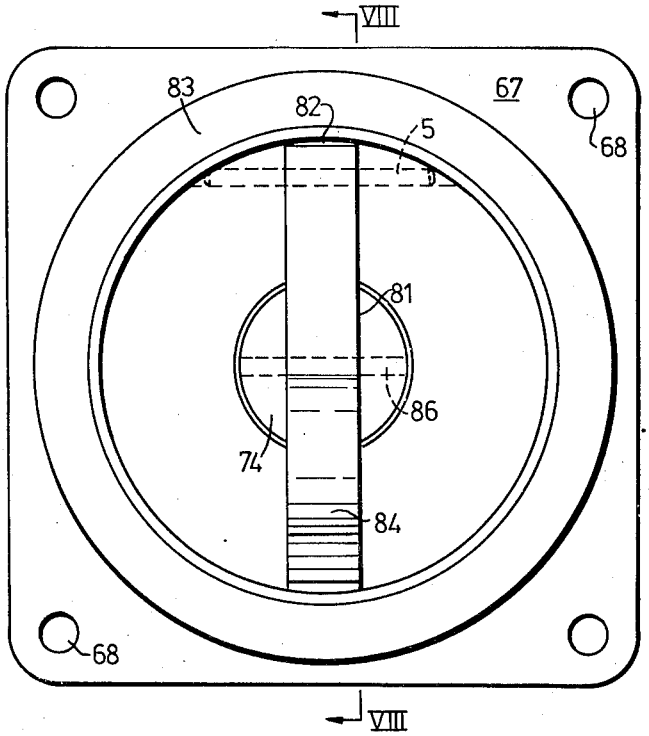
-FIG.7.-

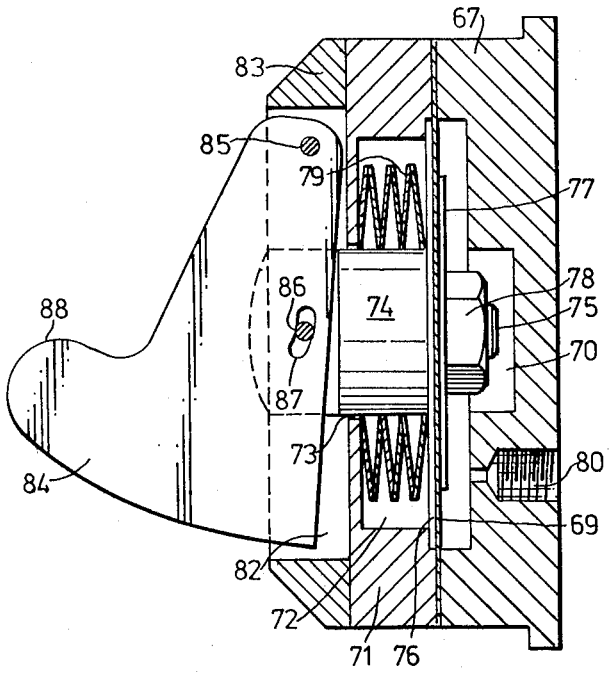
-FIG. 8-

RELEASABLE RETAINING MEANS AND FIRE DOOR CONTROL SYSTEM

This application is a continuation-in-part of Ser. No. 793,433, filed May 3, 1977, now U.S. Pat. No. 4,121,319.

FIELD OF THE INVENTION

This invention relates to releasable retaining means for controlling displacement of an object from a predetermined position relative to another object and has particular, though not exclusive, application to a door control for holding a door in the open position against the action of a spring or other automatic door closer.

BACKGROUND OF THE INVENTION

Hospitals, schools, hotels, offices, factories and other like buildings are commonly provided with so-called fire doors which, although they may have only a limited resistance to combustion, also serve the purpose of restricting the spread of smoke and/or the supply of combustion air in the event of a fire. Because of this latter purpose, it is desirable that all fire doors in a building should be closed immediately a fire breaks out even if such doors are remote from the seat of the fire. For this reason, it is preferred that fire doors be kept shut at all times. However, in practice, they are frequently wedged open to permit free passage.

OBJECT OF THE INVENTION

This invention provides means which are applicable, inter alia, for retaining fire doors in the open position against the action of the spring or other automatic door closers, with remote control release and which can be actuated if a fire is detected.

SUMMARY OF THE INVENTION

According to the invention, in one aspect, there is provided a fire door control system comprising a latch having a first part adapted to be mounted on a door and a second part adapted to be mounted in a fixed position relative to the door for cooperation with the first part when the door is in an open position, the second part including holding means operative, when actuated, to engage with the first part to inhibit closing movement of the door and pneumatically operated actuating means for actuating the holding means when a gas pressure differing from atmospheric pressure is applied thereto, the system further comprising a gas pressure source connected to the actuating means and valve means for establishing communication between the actuating means and atmosphere.

According to the invention, in another aspect, there is provided retaining means for controlling displacement of an object from a predetermined position relative to another object, comprising a first part for mounting on one of the objects and a second part for mounting on the other object and having holding means for latching engagement with the first part to inhibit relative displacement between the two objects and pneumatically operated means operative when a first pressure differential is applied thereto to inhibit operation of the holding means and operative when a second pressure differential is applied thereto to permit operation of the holding means, the first part being moveable into engagement with the holding means during times when the second pressure differential is applied.

BRIEF DESCRIPTION OF THE DRAWINGS

FIG. 1 is a plan view of a first part of a door holder in accordance with the invention, FIG. 2 is a front elevational view of a second part of a door holder in accordance with the invention, FIG. 3 is a cross-sectional view taken on the line III—III of FIG. 2, showing the first part of the door holder in engagement with the second part thereof, FIG. 5 is a plan view of a first part of a door holder in accordance with another embodiment of the invention, FIG. 6 is a side elevational view of the part shown in FIG. 5, FIG. 7 is a front elevational view of a second part of a door holder, for cooperation with the first part shown in FIGS. 5 and 6, and FIG. 8 is a cross-sectional view taken on the line VIII—VIII in FIG. 7.

DESCRIPTION OF THE PREFERRED EMBODIMENTS

Figure 4:
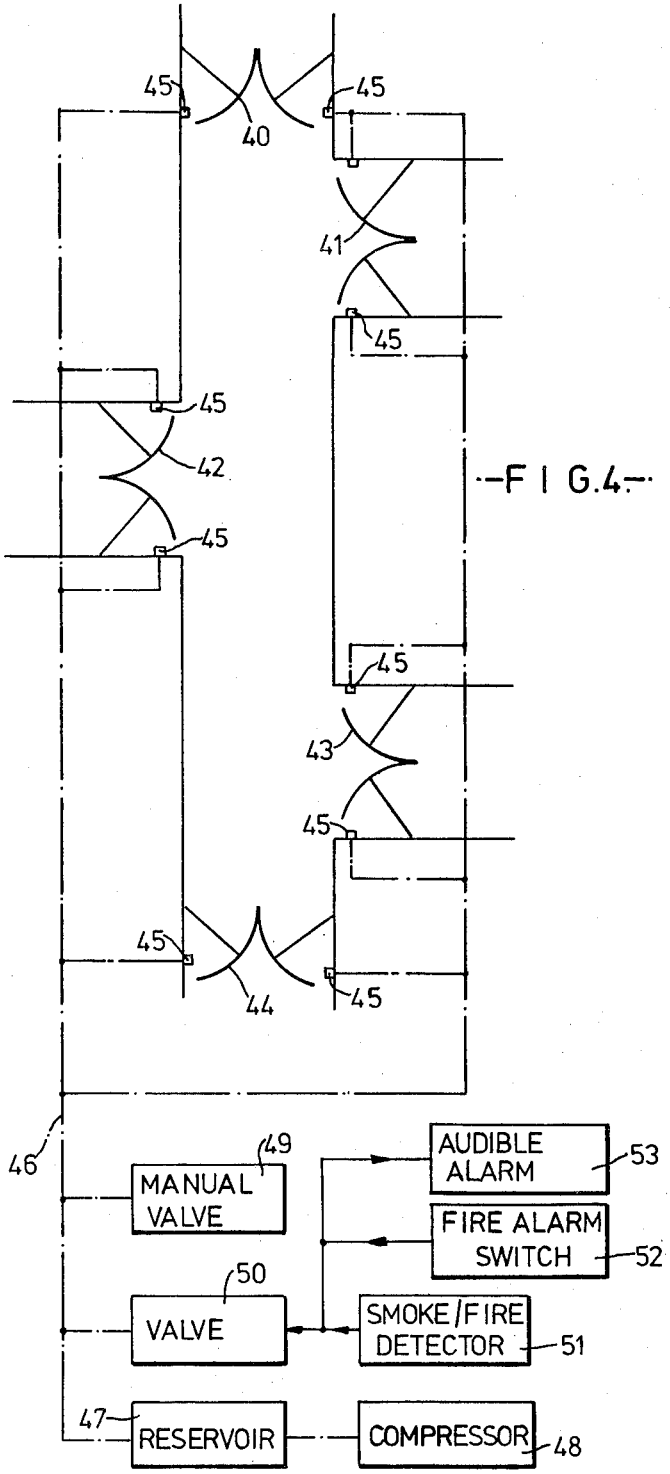
FIG. 4 is a schematic diagram of part of a building fitted with a fire door control system in accordance with the invention.

Referring first to FIG. 1, the part of the door holder intended to be mounted on to the door comprises a bracket 10 for mounting on the face of the door which confronts an adjacent wall when the door is open. A horizontally projecting arm 11 is pivotally mounted on the bracket 10 for limited angular movement about a pivot pin 12 and a flattened spherical element 13 is mounted on the outer end of the arm. The arm 11 is a loose fit on the pivot pin 12 and the flattened spherical element 13 is a loose fit on the end of the arm so as to form a sort of floating knob, the arrangement being such as to provide a degree of tolerance for the positioning of the bracket 10 on the door relative to the position of the other part of the door holder with which it is to engage.

FIGS. 2 and 3 show the other part of the door holder which comprises a base member 15 for mounting on a wall against which the door opens. The base member 15 has a recess 16 opening on the side remote from the wall and which is closed by a diaphragm 17 to form a chamber 16*a*, the diaphragm being clamped against the base member 15 by an outer housing member 18. The housing member 18 is also formed with a recess 19 which is closed by the diaphragm on one side and which communicates with a through bore 20 on the other. A hollow cylindrical slider 21 is mounted in the through bore 20 and has a closed end in contact with the diaphragm 17. A threaded stud 22 on the slider 21 projects through the diaphragm 17 enabling the slider to be clamped to the diaphragm 17 by a nut 23. A plate 24 clamped between the diaphragm 17 and the slider 21 engages in a stepped portion of the periphery of the recess 19 to prevent the diaphragm 17 from bowing into the recess 19 while allowing it to bow into the chamber 16*a*. However, the extent of travel of this latter bowing action is limited by abutment of the end of the stud 22 with the wall of the recess 16. A spring 25 in the recess 19 engages with the plate 24 to urge the diaphragm and slider away from the position shown in FIG. 3 so that the end of the stud 22 engages with the wall of the recess 16. A pneumatic inlet 26 communicates with the chamber 16*a* so that, by application of air pressure thereto, the diaphragm 17 may be displaced into the position shown in FIG. 3, thereby compressing the spring 25.

Four symmetrically disposed radial bores 27, 28, 29 and 30 extend inwardly to the central axial bore 20 in the housing member 18. Each of these radial bores 27, 28, 29 and 30 is aligned with a respective hole of smaller diameter in the slider 21 when the latter, together with the diaphragm 17, is in the position shown in FIG. 3. The outer end of each of the radial bores 27, 28, 29 and 30 is closed by a plug 31 and a steel ball 32, of diameter larger than that of the corresponding hole in the slider 21, is disposed at the inner end thereof. A spring 33 is disposed between the plug 31 and steel ball 32 to urge the latter into contact with the slider 21 so that, when the latter is in the position shown in FIG. 3, the ball 32 protrudes through the corresponding hole therein. Accordingly, when the door is opened and the stem 11 of the part mounted thereon enters the axial bore 20 of the housing member 18, the knob 13 depresses the balls 32 in their radial bores against the loading of their springs 33, the balls being spring returned to engage behind the knob 13 after it has passed to the position shown in FIG. 3 to retain the door in the open position. However, if the door is pulled with a force sufficient to compress the springs 33, the balls 32 are pressed outwardly in their radial bores clear of the path of the knob 13 and the holder releases. The knob 13 and balls 32 thus form a spring catch.

In normal use, compressed air is supplied to the chamber 16*a* by way of the inlet 26 in order to maintain the diaphragm in the position shown in FIG. 3 so that the holder operates as described above. However, if the air pressure in the chamber 16*a* is reduced so that the diaphragm 17 is moved to the right, as viewed in FIG. 3, by the spring 25 the holes in the slider 21 move out of alignment with the radial bores 27, 28, 29 and 30 and press the balls 32 radially outwardly and clear of the path of the knob 13, thereby releasing the door.

FIG. 4 shows part of a building having five sets of double fire doors 40, 41, 42, 43 and 44, each door being provided with a respective conventional spring door closer (not shown) and a respective door holder 45 in accordance with the invention. The pneumatic inlets 26 (FIG. 3) of all the door holders 45 are connected to a pneumatic main 46 which is shown in chain-dotted lines.

The main 46 is connected to a reservoir 47 which, in turn, is connected to a compressor 48 for maintaining a pressure of about 80 lbs./sq. in. in the reservoir 47. Also connected to the main 46 are a manually operated valve 49 and an automatically operated valve 50 both of which are connected to atmosphere so that, when open, they release the pressure in the main 46. The valve 50 is arranged to be operated both by a smoke/fire detector 51 and in response to actuation of a manual fire alarm switch 52. The smoke/fire detector 51 and fire alarm switch 52 may also be connected to operate an audible fire alarm 53.

Thus, either when smoke or a fire is detected by the detector 51 or when the fire alarm switch 52 is actuated, the pressure in the main 46 is released, thereby causing the door holders 45 to release their doors 40 to 44 which close under the action of their respective door closers. Since the presence of air pressure in the main 46 is necessary to keep the doors 40 to 44 open, any fault in the system will cause the doors to close, thereby providing fail/safe operation. When the building is not occupied, all the fire doors can be closed by momentarily opening the manual valve 49.

Another form of door holder in accordance with the invention is illustrated in FIGS. 5 to 8. Referring to FIGS. 5 and 6, the part of the door holder intended to be mounted on the door comprises a catch plate 60 having a base portion 61, adapted to be secured to the door by fixing means passing through a set of holes 62, and a portion 63 projecting at right angles to the base portion 61 and containing a rectangular aperture 64. The edge 65 of the aperture 64 furthest from the bade plate 61 serves as a detent surface for engagement with the other part of the door holder as will be explained hereinafter. A pivot ridge 66 is formed centrally on the back of the base portion so that, by adjusting the fixing means extending through the holes 62, the catch plate 60 can be pivotted about the ridge 66 to provide a limited amount of adjustment of the position of the edge 65.

FIG. 7 and 8 show the other part of the door holder which comprises a base member 67 which is adapted to be secured to a wall or other retaining surface by suitable fixing means extending through holes 68 therein. The base member 67 has a recess opening on the side remote from the wall and covered by a diaphragm 69 to form a chamber 70, the diaphragm 69 being clamped against the base member 67 by an outer housing member 71. The outer housing member 71 is also formed with a recess 72 which is closed by the diaphragm 69 on one side and which communicates with a through bore 73 on the other. A cylindrical coupling member 74 extends through the bore 73 and has a threaded stud 75 formed on its inner end. The stud 75 extends through a diaphragm stop plate 76, then through the diaphragm 69 and finally through a retaining plate 77. A nut 78 is screwed on to the stud 75 so that the diaphragm 69 is clamped between the diaphragm stop late 76 and the retaining plate 77 and secured fast with the coupling member 74. The retaining plate 77 engages in a step portion of the periphery of the recess 72 in the outer housing member 71 to prevent the diaphragm 69 from bowing into the recess 72 while allowing it to bow into the chamber 70. However, the extent of travel of this latter bowing action is limited by abutment of the end of the stud 75 with the wall of the chamber 70.

A spring 79 in the recess 72 engages with the retaining plate 77 to urge the diaphragm 69 and coupling member 74 away from the position shown in FIG. 8 so that the end of the stud 75 engages with the wall of the chamber 70. A pneumatic inlet 80 communicates with the chamber 70 so that, by application of air pressure thereto, the diaphragm 69 may be displaced into the position shown in FIG. 8, thereby compressing the spring 79.

The outer end of the cylindrical coupling member 74 has a transverse slot 81 aligned with a corresponding slot 82 in the outer housing member 71. The radially outer ends of the slot 82 are bounded by a bezel ring 83. A shaped latch plate 84 is located in the slots 81 and 82 and pivotally mounted on a pivot pin 85 secured to the outer housing member 71. An operating pin 86, extending across the slot 81 in the coupling member 74, projects through an elongate hole 87 in the latch plate 84 so that axial movement of the cylindrical coupling member 74 causes angular movement of the latch plate 84 and vice versa.

The outer end of the latch plate 84 has a hook formation 88 which, when the two parts of the door holder are suitably aligned, can extend into the aperture 64 so as to engage with the edge 65 thereof. When the door is opened, the formation 88 engages with the leading edge 89 of the catch plate 60 so that the latch plate 84 moves in an anti-clockwise direction, as viewed in FIG. 8, compressing the spring 79. As soon as the two parts have approached one another sufficiently closely to permit engagement of the formation 88 in the aperture 64, the spring 79 causes the latch plate 84 to move back in the clockwise direction into the position shown in FIG. 8. The door is thus retained in the open position but, if it is pulled with a force sufficient to compress the spring 79, the latch plate 84 is displaced in the anti-clockwise direction and the holder releases.

The door holder shown in FIGS. 5 to 8 operates in a similar manner to the door holder shown in FIGS. 1 to 3, compressed air being supplied to the chamber 70 by way of the inlet 80. If the air pressure in the chamber 70 is reduced, the diaphragm is moved to the right, as viewed in FIG. 8, by the spring 79 and the plate 84 moves in the anti-clockwise direction thereby releasing the door.

In FIG. 7, the air inlet 80 is shown as extending inwardly from the back of the base member 67. This configuration is suitable for use with concealed pipework. If surface pipework is to be employed, the air inlet may be provided in one of the side walls of the base member.

In a fire door control system of the type illustrated in FIG. 4, it is not necessary for all the door holders 45 to be identical with one another.

As used hereinbefore and in the appended claims, the term "pneumatically operated means" is intended to include not only means operated by air but also means operated by fluids other than air.

I claim:

1. A fire door control system comprising a latch having a first part adapted to be mounted on a door and a second part adapted to be mounted in a fixed position relative to the door for cooperation with the first part when the door is in an open position, the second part including holding means operative, when actuated, to engage with the first part to inhibit closing movement of the door and pneumatically operated actuating means for actuating the holding means when a gas pressure differing from atmospheric pressure is applied thereto, the system further comprising a gas pressure source connected to the actuating means and valve means for establishing communication between the actuating means and atmosphere.

2. Retaining means for controlling displacement of an object from a predetermined position relative to another object, comprising a first part for mounting on one of the objects and a second part for mounting on the other object and having holding means for latching engagement with the first part to inhibit relative displacement between the two objects and pneumatically operated means operative when a first pressure differential is applied thereto to inhibit operation of the holding means and operative when a second pressure differential is applied thereto to permit operation of the holding means, the first part being moveable into engagement with the holding means during times when the second pressure differential is applied.

3. A fire door control system comprising a latch having a first part adapted to be mounted on a door and a second part adapted to be mounted in a fixed position relative to the door for cooperation with the first part when the door is in an open position, the second part including holding means operative, when actuated, to engage with the first part to inhibit closing movement of the door and pneumatically operated actuating means for actuating the holding means when a gas pressure differing from atmospheric pressure is applied thereto, the system further comprising a gas pressure source connected to the actuating means and valve means for establishing communication between the actuating means and atmosphere, and a smoke and/or fire detector for opening the valve means.

4. A fire door control system comprising a plurality of latches, each latch having a first part adapted to be mounted on a door and a second part adapted to be mounted in a fixed position relative to the door for cooperation with the first part when the door is in an open position, the second part including holding means operative, when actuated, to engage with the first part to inhibit closing movement of the door and pneumatically operated actuating means for actuating the holding means when a gas pressure differing from atmospheric pressure is applied thereto, the system further comprising a common gas pressure source connected to all of said actuating means and common valve means for establishing communication between all of said actuating means and atmosphere.

5. Retaining means for controlling displacement of an object from a predetermined position relative to another object, comprising a first part for mounting on one of the objects and a second part for mounting on the other object and having holding means for latching engagement with the first part to inhibit relative displacement between the two objects and pneumatically operated means operative when a first pressure differential is applied thereto to inhibit operation of the holding means and operative when a second pressure differential is applied thereto to permit operation of the holding means, the first part being movable into engagement with the holding means during times when the second pressure differential is applied, the pneumatically operated means comprising an intermediate actuating member movable into a first position in which operation of the holding means is inhibited and pneumatic pressure sensing means operative to displace the release means into the second position in which operation of the holding means is not inhibited.

6. Retaining means according to claim 5, wherein the intermediate actuating means is spring biased into its first position.

7. Retaining means according to claim 5, wherein the holding means is so arranged that, when the intermediate member is in its second position, the first part disengages from the holding means on application of a displacing force exceeding a threshold value.

8. Retaining means for controlling displacement of an object from a predetermined position relative to another object, comprising a first part for mounting on one of the objects and a second part for mounting on the other object and having holding means for latching engagement with the first part to inhibit relative displacement between the two objects and pneumatically operated means operative when a first pressure differential is applied thereto to inhibit operation of the holding means and operative when a second pressure differential is applied thereto to permit operation of the holding means, the first part being movable into engagement with the holding means during times when the second pressure differential is applied, the pneumatically operated means including a chamber, one wall of which is formed by a diaphragm having the holding means operatively coupled to a central region thereof whereby establishment of a pressure differential across the diaphragm causes the release means to be moved from said first position to said second position.

9. Retaining means for controlling displacement of an object from a predetermined position relative to another object, comprising a first part for mounting on one of the objects and a second part for mounting on the other object and having holding means for latching engagement with the first part to inhibit relative displacement between the two objects and pneumatically operated means operative when a first pressure differential is applied thereto to inhibit operation of the holding means and operative when a second pressure differential is applied thereto to permit operation of the holding means, the first part being movable into engagement with the holding means during times when the second pressure differential is applied, the holding means comprising a holding member which is angularly movable between a first position in which it is operative to engage with the first part and a second position in which such engagement is inhibited, the retaining means further comprising spring-biasing means for urging the holding member into its second position and the pneumatically operated means being operative to displace the holding member into its first position.

10. Retaining means according to claim 9, wherein the holding member is so arranged that, when it is in its first position, the first part disengages with the second part on application of a displacing force exceeding a threshold value.

11. Retaining means according to claim 9, wherein the first part comprised a member which cooperates with the holding member to form a spring catch.

12. Retaining means according to claim 9, wherein the first part as a detent surface and the holding member comprises a plate mounted for angular movement about an axis perpendicular to its surface and having an edge shaped to engage with the detent surface when the plate is in its first position.

13. Retaining means according to claim 12, wherein the pneumatically operated means is adapted to hold the plate in a position in which the detent surface can freely move past the said edge.

14. Retaining means according to claim 9, wherein the first part comprises a plate containing an aperture, said plate being mounted parallel to the direction of relative movement between the first and second part, the detent surface being an edge of the aperture.

15. Retaining means for controlling displacement of an object from a predetermined position relative to another object, comprising a first part for mounting on one of the objects and a second part for mounting on the other object and having holding means for latching engagement with the first part to inhibit relative displacement between the two objects and pneumatically operated means operative when a first pressure differential is applied thereto to inhibit operation of the holding means and operative when a second pressure differential is applied thereto to permit operation of the holding means, the first part being movable into engagement with the holding means during times when the second pressure differential is applied, the pneumatically operated means comprising a chamber, one wall of which is formed by a diaphragm, and a coupling member one end of which is secured to a central region of the diaphragm and the other end of which is connected to the holding member whereby establishment of a pressure differential across the diaphragm causes the holding means to be urged from its second position to its first position.

* * * * *